US008733470B2

(12) United States Patent
Matthias et al.

(10) Patent No.: US 8,733,470 B2
(45) Date of Patent: May 27, 2014

(54) ELECTRIC MACHINE TOOL

(75) Inventors: Wolf Matthias, Stuttgart (DE); Rainer Glauning, Leinfelden-Echterdingen (DE)

(73) Assignee: Robert Bosch GmbH, Stuttgart (DE)

( * ) Notice: Subject to any disclaimer, the term of this patent is extended or adjusted under 35 U.S.C. 154(b) by 304 days.

(21) Appl. No.: 13/001,900

(22) PCT Filed: May 14, 2009

(86) PCT No.: PCT/EP2009/055843

§ 371 (c)(1),
(2), (4) Date: Mar. 10, 2011

(87) PCT Pub. No.: WO2010/000535

PCT Pub. Date: Jan. 7, 2010

(65) Prior Publication Data

US 2011/0147031 A1 Jun. 23, 2011

(30) Foreign Application Priority Data

Jul. 2, 2008 (DE) ..... 10 2008 040 061

(51) Int. Cl.
*B25F 5/02* (2006.01)

(52) U.S. Cl.
USPC ..... 173/217; 173/170; 173/171; 320/112; 320/114; 320/116; 320/120

(58) Field of Classification Search
USPC ..... 320/112, 114, 116, 117, 120; 173/217, 173/170, 171
See application file for complete search history.

(56) References Cited

U.S. PATENT DOCUMENTS

| | | | | |
|---|---|---|---|---|
| 4,081,704 | A | 3/1978 | Vassos et al. | |
| 4,788,480 | A | 11/1988 | Field et al. | |
| 5,028,858 | A | 7/1991 | Schnizler et al. | |
| 5,054,563 | A | 10/1991 | Zapf | |
| 6,104,162 | A | 8/2000 | Sainsbury et al. | |
| 6,502,949 | B1 | 1/2003 | Horiyama et al. | |
| 6,597,152 | B1 | 7/2003 | Jacobs et al. | |
| 6,605,923 | B1 * | 8/2003 | Kellogg | 320/112 |
| 7,182,150 | B2 * | 2/2007 | Grossman | 173/198 |
| 2005/0044051 | A1 | 2/2005 | Selby et al. | |
| 2005/0082920 | A1 | 4/2005 | Heigl et al. | |
| 2008/0135272 | A1 | 6/2008 | Wallgreen | |
| 2010/0062326 | A1 | 3/2010 | Konuma et al. | |
| 2011/0197389 | A1 * | 8/2011 | Ota et al. | 15/339 |

FOREIGN PATENT DOCUMENTS

| | | |
|---|---|---|
| CA | 2075413 | 2/1993 |
| CN | 2659647 | 12/2004 |
| CN | 2796963 | 7/2006 |
| CN | 100999074 | 7/2007 |

(Continued)

OTHER PUBLICATIONS

International Search Report for PCT/EP2009/055843 dated Aug. 27, 2009 (Form PCT/ISA/210).

*Primary Examiner* — Michelle Lopez
(74) *Attorney, Agent, or Firm* — Michael Best & Friedrich LLP

(57) ABSTRACT

An electric machine tool may include an interface via which the electric machine tool can be mechanically and electrically connected to a battery pack. A coupling apparatus may be provided, which can be mechanically and electrically connected to the electric machine tool via the interface. The coupling apparatus may include a first battery interface for connection to a first battery pack and a second battery interface for connection to a second battery pack.

9 Claims, 1 Drawing Sheet

(56) References Cited

FOREIGN PATENT DOCUMENTS

| | | | |
|---|---|---|---|
| CN | 201032642 | | 3/2008 |
| GB | 2 409 831 | | 7/2005 |
| GB | 2409831 | A | 7/2005 |
| GB | 2409831 | B | 3/2006 |
| JP | 55-130079 | | 10/1980 |
| JP | 10-12204 | | 1/1998 |
| JP | 2000308268 | A | 11/2000 |
| JP | 2003-71746 | | 3/2003 |
| JP | 2008073799 | | 4/2008 |
| JP | 2010084641 | A | 4/2010 |
| WO | 0077876 | A1 | 12/2000 |
| WO | WO 00/77876 | | 12/2000 |
| WO | WO 2007/058596 | | 5/2007 |

* cited by examiner

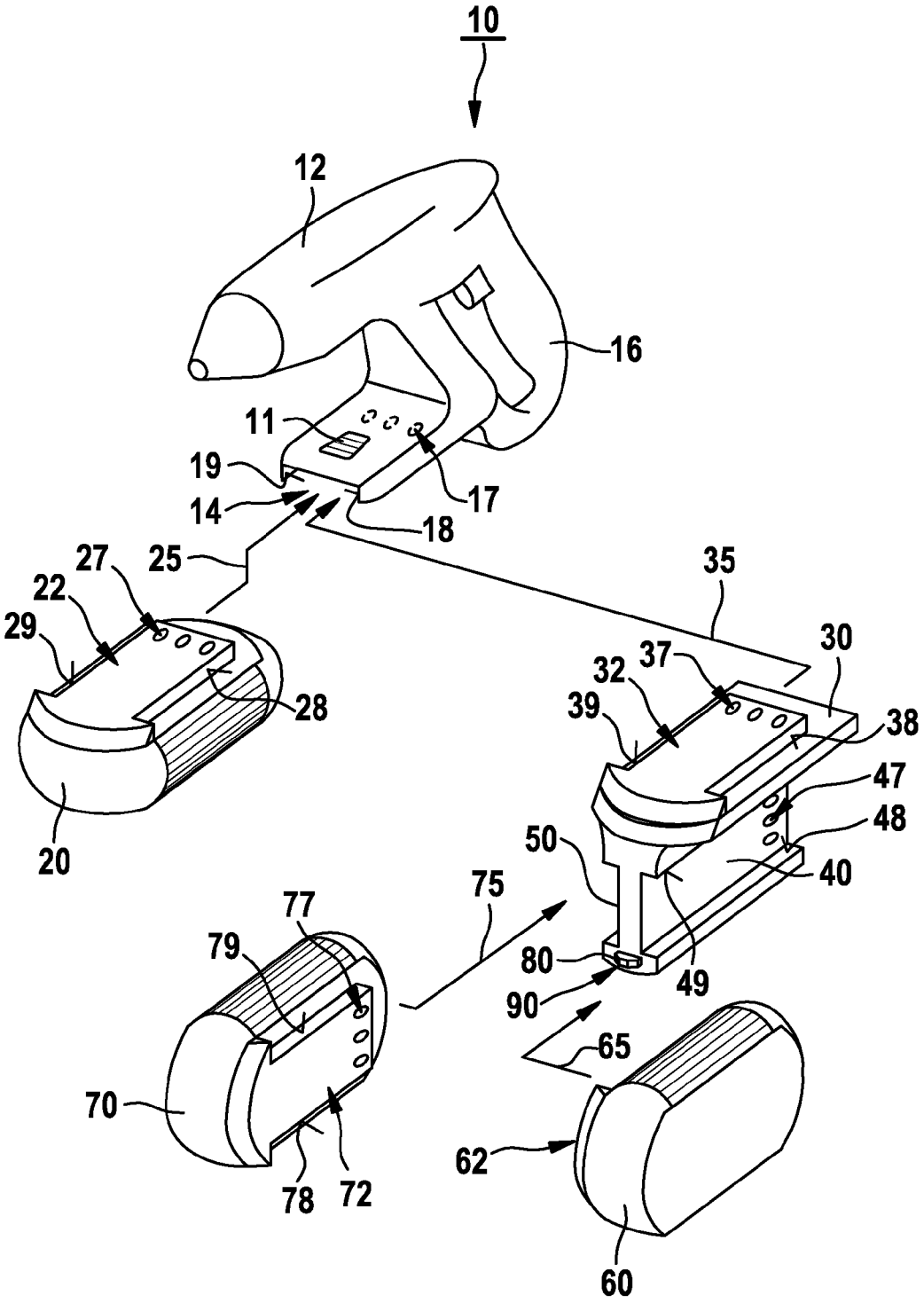
10
12
16
11
19
14
17
18
25
27
22
29
28
20
35
30
37
32
39
38
47
48
50
40
75
77
79
80
49
90
65
70
62
78
72
60

ELECTRIC MACHINE TOOL

This application is a National Stage Application of PCT/EP2009/055843, filed May 14, 2009, which claims benefit of Serial No. 10 2008 040 061.0, filed Jul. 2, 2008 in Germany and which applications are incorporated herein by reference. To the extent appropriate, a claim of priority is made to each of the above disclosed applications.

TECHNICAL FIELD

The present invention relates to an electric machine tool having an interface via which the electric machine tool can be mechanically and electrically connected to a battery pack.

Manufacturers of electric machine tools of this kind normally provide different battery packs with various design sizes and/or nominal voltages, each battery pack being associated with a certain type of electric machine tool according to its design size, its nominal voltage and/or its power output. As a rule, different battery types are also provided, such as, for example, NiCd, NiMh and Li-ion. Due to their high power density, Li-ion battery packs are particularly prevalent. Nominal voltage and capacity of the battery packs, which are used, respectively available, in each case, generally determine the power output and running time of the electric machine tools.

A disadvantage to the prior art is that electric machine tools, which require high amounts of energy and with which very high power peaks may be required for a short time, cannot be efficiently operated with currently available battery packs. This is the case, for example, with large angle grinders and chain saws. Furthermore, special rules for transport safety and handling apply to Li-ion battery packs if a certain capacity is exceeded. The cost effectiveness of such large Li-ion battery packs is thereby adversely affected.

SUMMARY

An aim of the invention is therefore to provide a new electric machine tool having an autonomous power supply, with which an operation requiring high amounts of energy with high power peaks and/or an extended running time is efficiently made possible with currently available battery packs.

This is aim is met by an electric machine tool having an interface via which the electric machine tool can be mechanically and electrically connected to a battery pack, a coupling apparatus being provided, which can be mechanically and electrically connected to the electric machine tool via the interface. The coupling apparatus has at least one first battery interface for connection to a first battery pack and a second battery interface for connection to a second battery pack.

The invention thereby allows for two or more battery packs to be provided for the operation of a single electric machine tool; thus enabling the running time thereof to be extended and or the power output thereof to be increased. The coupling apparatus thus allows the electric machine tool to be equipped specifically to the application with one or a plurality of battery packs. Electric machine tools, which were originally not designed by the manufacturer for operation with more than one battery pack, can also therefore be operated with two or more battery packs. Moreover, electric machine tools, which are intended for operation with a high-performance battery pack, can now alternatively be operated with two or more lower-performance battery packs of the same family.

The term electric machine tool is thereby not limited to hand-held electric power tools but also includes, for example, lawn mowers or bench-top systems such as large upright saws.

The coupling apparatus preferably has a coupling interface which can be mechanically or electrically connected to the interface of the electric machine tool. The first and the second battery pack preferably have in each case a connection interface, via which said first and the second battery pack can be selectively connected to the first and the second battery interface of the coupling apparatus or to the interface of the electric machine tool. Said first and the second battery pack preferably have identical design sizes, nominal voltages and/or capacities.

Hence, the battery interfaces provided on the coupling apparatus preferably correspond to the interface provided on the electric machine tool. During an operation with only one of the first or second battery packs, said battery pack can thus also be directly connected to the electric machine tool. According to the invention, the electric machine tool can therefore also be operated without the coupling apparatus.

According to one exemplary embodiment, the first and the second battery pack have different design sizes, nominal voltages and/or capacities.

Via the coupling apparatus, the electric machine tool can thus be mechanically and electrically connected to battery packs, which originally were not intended for the operation of said electric machine tool, the use of which however can bring about an increase in performance and/or an extension of the running time during the operation of said electric machine tool.

The coupling apparatus also particularly includes at least one control device, which allows the battery elements, which are coupled via said coupling apparatus, to be selectively controlled in order, for example, to use them consecutively, operate them simultaneously or also to discharge them equally.

The coupling apparatus can therefore preferably be configured to connect the first and second battery pack in parallel.

In so doing, the running time of the electric machine tool can be extended. By discharging the battery packs in parallel, the stress on each individual battery pack can furthermore be reduced and consequently a reduced self-heating is achieved; thus enabling the service life of the battery packs to be increased. In addition, a higher current can be provided to the electric machine tool as a result of discharging said battery packs in parallel than would be the case for a single battery pack operating according to specifications.

As an alternative to this, the coupling apparatus can be configured to connect the first and second battery pack in series.

The electric machine tool can thus be operated with a greater electrical voltage.

In this way, it is advantageously possible to hold the energy content of an individual battery under a danger threshold and at the same time to operate a piece of equipment, which has a significantly higher energy requirement.

According to one exemplary embodiment, the coupling apparatus has a switching device. This switching device is configured for the purpose of electroconductively connecting the electric machine tool during operation selectively to the first or to the second battery pack. Said switching device is preferably a manually operable switch.

During the operation of the electric machine tool, a switching operation can therefore occur between the first and the second battery pack as a function of the state of charge of said first, respectively said second, battery pack. In so doing, the running time of said electric machine tool can be extended.

The aim mentioned at the beginning of the application is also met by a coupling apparatus for an electric machine tool. The electric machine tool has an interface via which said electric machine tool can be mechanically and electrically connected to a battery pack. The coupling apparatus can be mechanically and electrically connected to said electric machine tool via the interface and has at least one first battery interface for connection to a first battery pack and a second battery interface for connection to a second battery pack.

BRIEF DESCRIPTION OF THE DRAWINGS

The invention is explained in detail in the following description with the aid of an exemplary embodiment which is depicted in the drawings.

The following is shown:

FIG. 1 a perspective depiction of an electric machine tool having a coupling apparatus according to the invention.

DETAILED DESCRIPTION

FIG. 1 shows an electric machine tool 10 having a housing 12, on which a handle 16 and an interface 14 are provided. The electric machine tool 10 can be mechanically and electrically connected to a battery pack 20 via the interface 14 for supplying network-independent electrical power. In FIG. 1, said electric machine tool 10 is configured by way of example as a cordless drill/driver. It should however be noted that the present invention is not limited to a cordless drill/driver but rather can be applied to various battery powered electric machine tools, for example to a hammer drill, an angle grinder or also in particular to larger electric machine tools which are not hand-held, such as lawn mowers etc.

The battery pack 20 has a connection interface 22 with guide, respectively detent, elements 28, 29 for guiding, respectively latching, said battery pack 20 in the interface 14 of the electric machine tool 10. Said interface 14 has corresponding guide rails, respectively counter-detent elements 18, 19, which interact with the guide, respectively detent, elements 28, 29 to provide a mechanical connection between said electric machine tool 10 and said battery pack 20. In order to provide an electrical connection between said battery pack 20 and said electric machine tool 10, contact elements 27 are provided on the connection interface 22 of said battery pack 20, which engage corresponding connection contacts 17, which in FIG. 1 are situated on the underside of the interface 14 and are therefore depicted using only dashed lines.

Before putting the electric machine tool 10 into operation, the battery pack 20 is inserted into the housing 12 in the direction of an arrow 25 and is latched there. In so doing, an electrical connection between the connection contacts 17 of the interface 14 and the contact elements 27 of the connection interface 22 is automatically established. The detent mechanism can be released to remove said battery pack 20, for example, by pressing a release button 11.

The electric machine tool 10 can then be used in a manner known per se. It should be noted that design and functionality of said electric machine tool 10, the interface 14, the battery pack 20 as well as the connection interface 22 are sufficiently known from the prior art and are therefore not further described.

According to one embodiment of the invention, a coupling apparatus 30 is provided, which instead of the battery pack 20 can be mechanically and electrically connected to the electric machine tool 10 via the interface 14. For this purpose, the coupling apparatus 30 has a coupling interface 32, which is at least compatible with and preferably substantially identical in construction to the connection interface 22 and has guide, respectively detent, elements 38, 39 and contact elements 37. A further description of the coupling interface 32 can thus be dispensed with. Likewise said coupling apparatus 30 can be inserted in the direction of an arrow 35 into the housing 12 and latched there for the mechanical and electrical connection to said electric machine tool 10 in an analogous manner to that described above with regard to the battery pack 20.

The coupling apparatus 30 is configured after the manner of a mechanical adapter and has at least one first battery interface 40 for connection to a first battery pack 60 and one second battery interface 50 for connection to a second battery pack 70. The invention is however not limited to two battery interfaces. In fact, adapters having three or more battery interfaces can also be implemented, for example, as a function of the housing size of an associated electric machine tool. For example, an adapter for a drill/driver can have two battery interfaces, whereas an adapter for a lawn mower has four battery interfaces.

According to one embodiment of the invention, the coupling apparatus 30 is configured for connecting the battery packs 60, 70 in parallel. The electric machine tool 10 can therefore use said battery packs 60, 70 sequentially in an operating mode, whereby the running time of said machine 10 is extended. In a further operating mode, a substantially higher power output can be achieved during periods of peak load by the simultaneous use of the two battery packs 60, 70. The continuous power output of said electric machine tool 10 can also be increased by simultaneously discharging both of the battery packs 60, 70. A network-independent electrical power supply for electric machine tools can thus also be achieved using the coupling apparatus 30. Such machine tools cannot be usefully operated with currently available battery packs, e.g. in the case of large angle grinders or chain saws.

According to a further embodiment of the invention, the coupling apparatus 30 is configured for connecting the battery packs 60, 70 in series. The electric machine tool 10 can thus be operated with a greater electrical voltage.

Depending on the embodiment of the coupling apparatus 30, said apparatus makes not only a simultaneous use of the battery packs 60, 70 by the electric machine tool 10 possible but also a simultaneous, respectively sequential, charging of said battery packs 60, 70 at a suitable charging interface. This simplifies the charging procedure particularly for a plurality of battery packs.

The battery interfaces 40, 50 are preferably embodied substantially identical in construction to the interface 14. For example, the battery interface 40 has guide rails, respectively counter-detent elements 48, 49, as well as connection contacts 47. A further description of the battery interfaces 40, 50 can therefore be dispensed with in this case.

According to one embodiment of the invention, the battery packs 60, 70 have identical design sizes, nominal voltages and/or capacities. As an alternative to this, said battery packs 60, 70 have different design sizes, nominal voltages and/or capacities.

The battery packs 60, 70 have connection interfaces 62, 72, which are embodied according to one embodiment of the invention substantially identical in construction to the connection interface 22 of the battery pack 20. For example, the connection interface 72 of the battery pack 70 has guide, respectively detent, elements 78, 79 as well as contact elements 77. A further description of the connection interfaces 62, 72 can therefore be dispensed with in this case. Said battery packs 60, 70 can therefore be selectively connected to one of the battery interfaces 40, 50 or to the interface 14 of the electric machine tool 10. Said battery pack 60, respectively 70, is inserted in the direction of arrow 65, respectively 75, into the coupling apparatus 30 and latched there for the mechanical and electrical connection to said battery interfaces 40, 50 in an analogous manner to that described above with regard to the battery pack 20.

It should be noted that an exemplary embodiment is described with regard to FIG. 1, wherein the connection interfaces 62, 72 are embodied substantially identical in construction to each other and to the connection interface 22 of the battery pack 20. It is however equally feasible to embody said connection interfaces 62, 72 such that they are different from each other in order to thereby allow for the use of battery packs of different manufacturers at the electric machine tool.

As can be seen in FIG. 1, the coupling apparatus 30 can have a switching device 90. The switching device 90 is configured for the purpose of electroconductively connecting the electric machine tool 10 during operation selectively to one of the battery packs 60, 70. Said switching device 90 can be implemented by means of a suitable control device of said electric machine tool 10. A manually operable switch 80, e.g. a toggle switch, is depicted by way of example for the implementation of said switching device 90.

A plurality of modifications and alterations to the electric machine tool 10 and to the coupling apparatus 30 is feasible within the scope of the present invention. Instead of said coupling apparatus 30, a plurality of interfaces for receiving a plurality of battery packs can be provided on the housing 12 of the electric machine tool 10. Furthermore, one of the battery interfaces 40, 50 on said coupling apparatus 30 can be a passive interface, i.e. an interface without contact elements, which merely serves to accommodate a spare battery pack.

The invention claimed is:

1. An electric machine tool comprising:

an interface via which the electric machine tool can be selectively mechanically and electrically connected to a single battery pack or to a coupling apparatus;

the coupling apparatus configured to mechanically and electrically connect to said electric machine tool via the interface, wherein the coupling apparatus has a first battery interface for connection to a first battery pack and a second battery interface for connection to a second battery pack, the coupling apparatus connecting the first battery pack in series with the second battery pack.

2. The electric machine tool according to claim 1, wherein the coupling apparatus has a coupling interface, which can be mechanically and electrically connected to the interface of the electric machine tool.

3. The electric machine tool according to claim 1, wherein the first battery pack and the second battery pack have in each case a connection interface, via which the first battery pack and the second battery pack can be selectively connected to the at least first and second battery interface of the coupling apparatus and to the interface of the electric machine tool.

4. The electric machine tool according to claim 1, wherein the first battery pack and the second battery pack have identical design sizes, nominal voltages and/or capacities.

5. The electric machine tool according to claim 1, wherein the first battery pack and the second battery pack have different design sizes, nominal voltages and/or capacities.

6. The electrical machine tool of claim 1, wherein the first battery pack and the second battery pack are configured to discharge simultaneously.

7. The electrical machine tool of claim 1, wherein the first battery interface and the second battery interface are substantially identical in construction to the interface.

8. The electrical machine tool of claim 1, wherein the coupling apparatus is configured in a manner of a mechanical adapter.

9. An electric machine tool comprising:

an interface via which the electric machine tool can be mechanically and electrically connected to a coupling apparatus;

the coupling apparatus configured to mechanically and electrically connect to said electric machine tool via the interface, wherein the coupling apparatus has a first battery interface for connection to a first battery pack and a second battery interface for connection to a second battery pack, wherein the first battery pack and the second battery pack have in each case a connection interface, via which the first battery pack and the second battery pack can be selectively connected to the at least first and second battery interface or to the interface of the electric machine tool.

* * * * *